US008328707B2

(12) United States Patent
Pressman et al.

(10) Patent No.: US 8,328,707 B2
(45) Date of Patent: Dec. 11, 2012

(54) FOLDER FOR VARIABLE THICKNESS COLLATIONS

(75) Inventors: Benjamin L. Pressman, Baltimore, MD (US); Alejandro J. De Simone, Madrid (ES); Vijay K. Aiyar, Kendall Drive, NJ (US); Louis Agon, Neuilly (FR)

(73) Assignee: Pitney Bowes Inc., Stamford, CT (US)

( * ) Notice: Subject to any disclaimer, the term of this patent is extended or adjusted under 35 U.S.C. 154(b) by 436 days.

(21) Appl. No.: 12/647,684

(22) Filed: Dec. 28, 2009

(65) Prior Publication Data

US 2011/0160027 A1 Jun. 30, 2011

(51) Int. Cl.
*B31F 1/10* (2006.01)

(52) U.S. Cl. ..... 493/424; 493/415; 493/420; 493/448

(58) Field of Classification Search ..... 493/405, 493/413, 415, 420, 424, 445, 448
See application file for complete search history.

(56) References Cited

U.S. PATENT DOCUMENTS

| | | | | | |
|---|---|---|---|---|---|
| 3,627,305 | A | * | 12/1971 | Heigl et al. | 493/342 |
| 4,032,133 | A | * | 6/1977 | Steffens et al. | 493/421 |
| 4,125,254 | A | * | 11/1978 | Boyer | 493/8 |
| 4,498,663 | A | * | 2/1985 | Wamsley et al. | 270/52.04 |
| 5,082,255 | A | * | 1/1992 | Brigante et al. | 270/45 |
| 5,190,514 | A | * | 3/1993 | Galvanauskas | 493/420 |
| 5,673,910 | A | * | 10/1997 | Wamsley | 271/259 |
| 5,980,439 | A | | 11/1999 | Johnson et al. | |
| 2007/0063409 | A1 | * | 3/2007 | Sugimoto et al. | 270/58.09 |

* cited by examiner

*Primary Examiner* — Paul R Durand
(74) *Attorney, Agent, or Firm* — Brian A. Collins; Charles R. Malandra, Jr.; Steven J. Shapiro

(57) ABSTRACT

A folder includes a plurality of rotatable fold rollers and a plurality of rotatable nip rollers. Each nip roller forms a nip having a nip spacing with an adjacent fold roller. The nips may include an input nip for receiving collations, a plurality of intermediate nips for delivering the collations to one of a buckle chute and a deflector to form folded collations, and an output nip for discharging the folded collations. The folder may further include an adjustment system associated with each nip roller for selectively moving the nip roller with respect to the adjacent fold roller based on predetermined collation thickness data to change the nip spacing for sequential collations.

14 Claims, 4 Drawing Sheets

FOLDER FOR VARIABLE THICKNESS COLLATIONS

FIELD OF THE INVENTION

The present invention relates to a folder and, more particularly, to a folder for folding variable thickness collations.

BACKGROUND OF THE INVENTION

Folders are used in many document production and handling applications, such as in mail finishing systems, for example. In those applications it is necessary for the folders to fold collations containing a variable number of documents and, therefore, having variable thicknesses.

Conventional folder systems utilize rollers arranged at fixed distances, creating nips having fixed sizes. Those nips are generally configured to process collations of a given size. In some arrangements, in order for the folder to process larger collations, manual adjustment of the rollers is required. The adjustment process is very time consuming and, once the rollers are adjusted for larger collations, the folder is unable to process smaller collations.

In other arrangements, passive, spring-biased rollers are used to adjust the roller spacing to accommodate collations having varied thicknesses. Such systems allow the processing of collations within a given thickness range, but lead to excessive force and noise when processing thicker collations. In addition, such systems often destroy the documents of the collation by leaving visible marks on the documents from the rollers.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a folder, comprising a plurality of rotatable fold rollers and a plurality of rotatable nip rollers. In one embodiment, each nip roller forms a nip having a nip spacing with an adjacent fold roller. In a further embodiment, the nips comprise an input nip for receiving collations, a plurality of intermediate nips for delivering the collations to one of a buckle chute and a deflector to form folded collations, and an output nip for discharging the folded collations. The folder may further comprise an adjustment system associated with each nip roller for selectively moving the nip roller with respect to the adjacent fold roller based on predetermined collation thickness data to change the nip spacing for sequential collations.

As used herein, "collation" means a collection of one or more documents.

In another aspect, the invention relates to a method of folding collations, comprising rotating a plurality of fold rollers and rotating a plurality of nip rollers. Each nip roller may form a nip having a nip spacing with an adjacent fold roller. In one embodiment, the method further comprises receiving collations in an input nip, delivering the collations to one of a buckle chute and a deflector to form folded collations in a plurality of intermediate nips, discharging the folded collations from an output nip, and selectively moving each nip roller with respect to the adjacent fold roller based on predetermined collation thickness data to change the nip spacing for sequential collations using an adjustment system associated with the nip roller.

In a further aspect, the invention provides a folder, comprising a plurality of rotatable fold rollers and at least one rotatable nip roller forming a nip with an adjacent fold roller for delivering collations to a buckle chute to form folded collations. The nip may define a nip spacing. In one embodiment, the folder further comprises an adjustment system associated with each nip roller for selectively moving the nip roller with respect to the adjacent fold roller based on predetermined collation thickness data to change the nip spacing for sequential collations. In a further embodiment, the adjustment system comprises an adjustment device associated with each end of a nip roller shaft. The adjustment device may comprise a fitting rotatably receiving the end of the shaft and a drive element for moving the fitting with respect to the adjacent fold roller.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the folder according the invention will be described with reference to certain applications in mailpiece inserter systems. It should be understood, however, that embodiments of the invention may be used in association with other systems configured to handle and transport collations.

Figure 1:
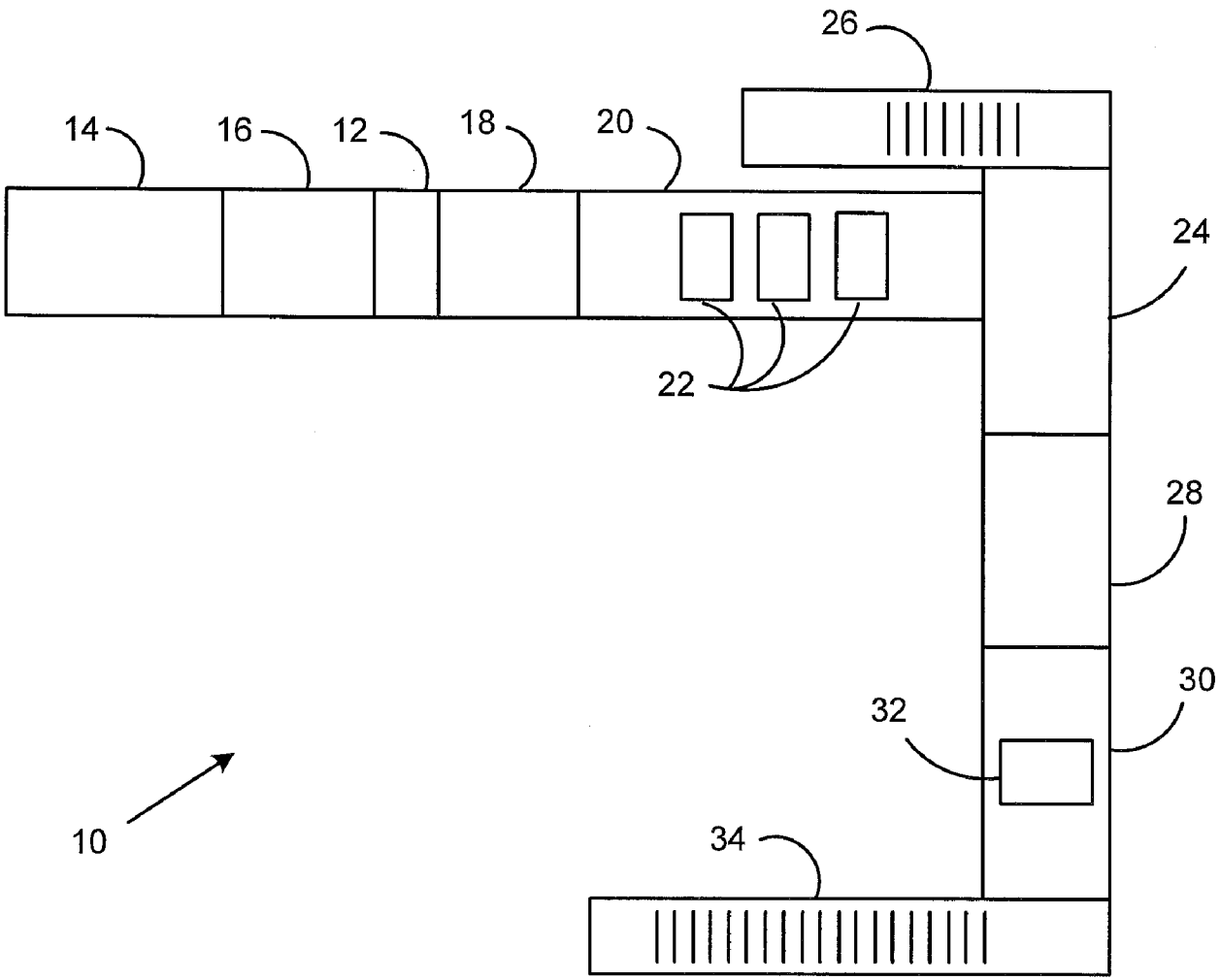
FIG. 1 is a schematic view of an inserter system utilizing an embodiment of the folder of the present invention.

A schematic view of an inserter system 10 incorporating the folder 12 of the invention is shown in FIG. 1. The illustrated exemplary inserter system 10 comprises a document feeder 14, which provides pre-printed documents for processing. The documents, which may comprise bills or financial statements, for example, may be provided by the document feeder 14 as individual "cut sheets," or may be cut from a spool using a web cutter (not shown).

The documents next move to an accumulator 16, where the documents for respective mailpieces are assembled into collations. The collations then enter the folder 12, as discussed below, where they are folded. The folded collations next move to a buffer 18, which holds the collations for sequential processing. The collations next move to a chassis 20. As each collation moves through the chassis, inserts from a plurality of feeder modules 22 are added to the collation.

The collations next enter an insertion area 24, where the finished collations are stuffed into envelopes provided by an envelope hopper 26, and the envelopes are sealed. The stuffed, sealed envelopes then enter an outsort module 28, for optionally diverting defective envelopes from the production stream. Defective envelopes may have collations that are improperly assembled and/or may be improperly sealed, for example.

The properly assembled and sealed envelopes next enter a metering and printing area 30, where markings, such as a postage indicia and/or address information, for example, are applied using a printer 32 to form completed mailpieces. Finally, the completed mailpieces are deposited on a conveyor 34. Other systems utilizing more or fewer components and/or different arrangements of components may also be used.

Figure 2:
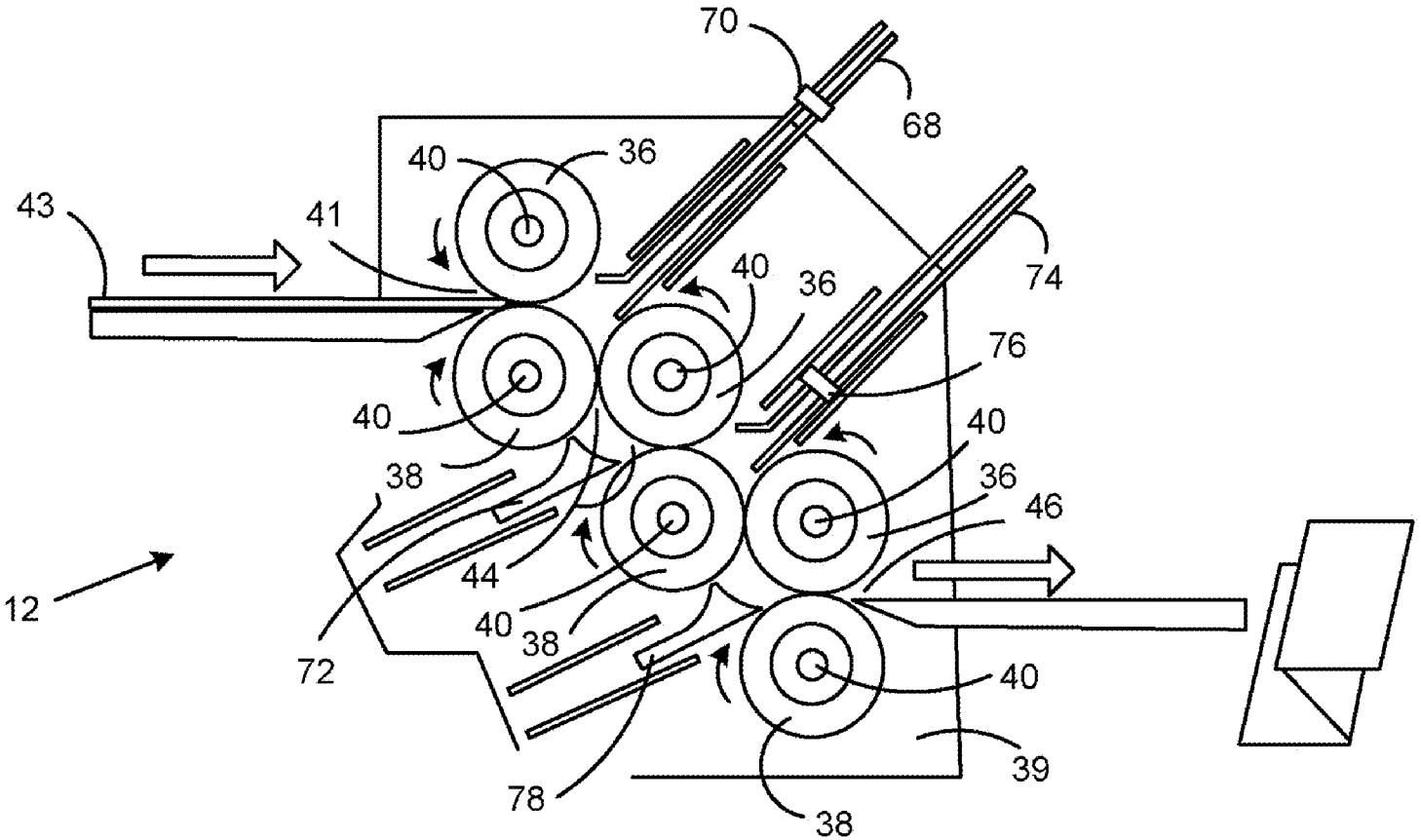
FIG. 2 is a schematic side view of an embodiment of the folder according to the invention.

The folder 12 of the present invention may allow a high quality fold to be consistently achieved for collations having a range of thicknesses without manual adjustment and without degradation of the collation. A schematic side view of an embodiment of the folder 12 according to the invention is shown in FIG. 2. As shown, the folder 12 comprises a plurality of rotatable fold rollers 36 and a plurality of rotatable nip rollers 38 secured in a housing 39. Each nip roller 38 forms a nip having a nip spacing with an adjacent fold roller 36.

Figure 3:
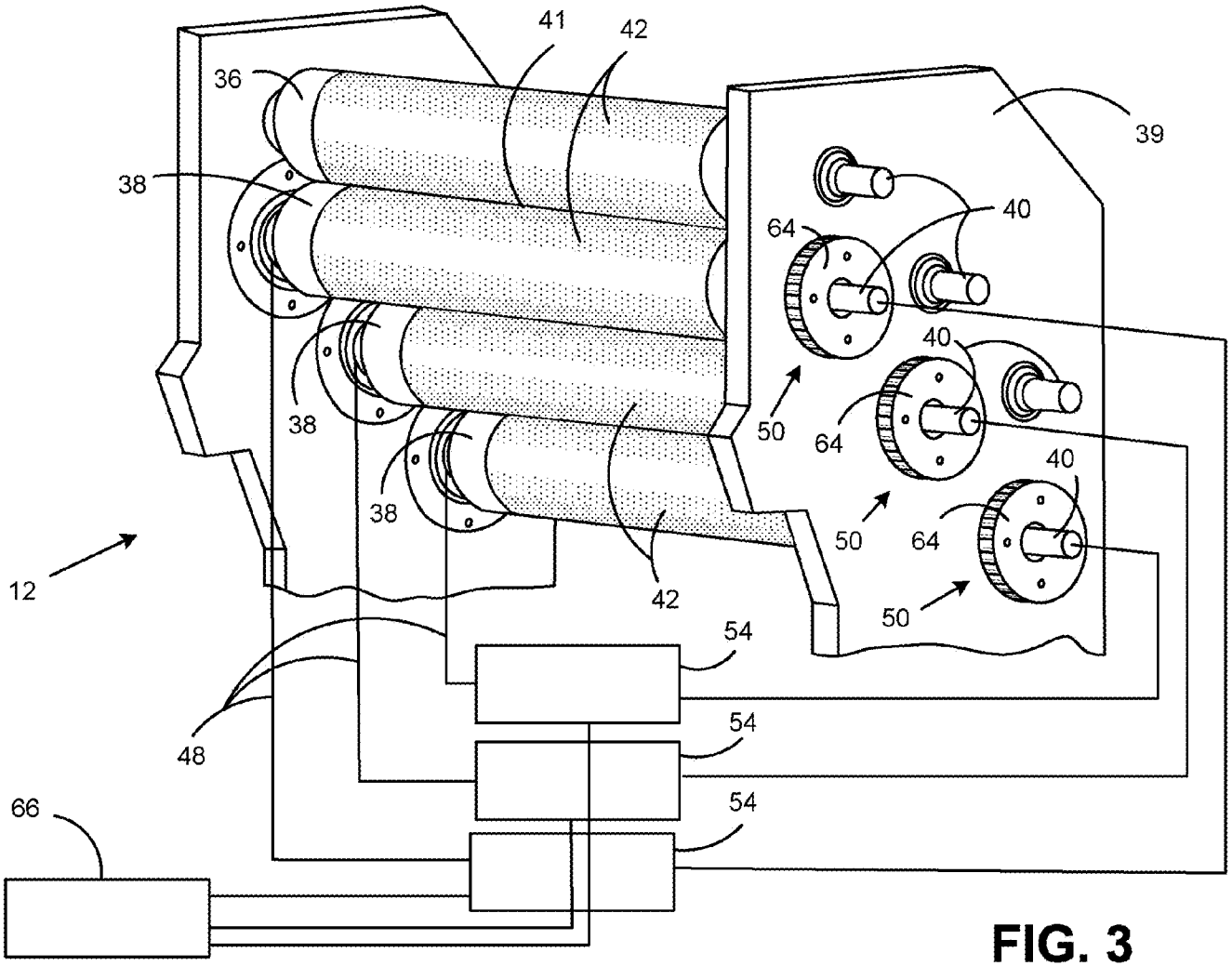
FIG. 3 is a partially schematic view of an embodiment of the folder according to the invention.

The fold rollers 36 and nip rollers 38 comprise a shaft 40 and a collation contact surface 42 disposed on the shaft, as shown in FIG. 3. The collation contact surface 42 may comprise rubber or other compliant material for gripping the collations 43 and compressing slightly, where required, to accommodate variations in collation thickness. The fold rollers 36 and nip rollers 38 are continuously rotated using A/C motors (not shown) in the directions shown by arrows in FIG. 2.

In the illustrated embodiment, the nips comprise an input nip 41 for receiving collations, a plurality of intermediate nips 44 for delivering the collations to one of a buckle chute and a deflector to form folded collations, and an output nip 46 for discharging the folded collations. Folders having different numbers of rollers and, therefore, different numbers of nips may also be used.

The illustrated embodiment further comprises an adjustment system 48 associated with each nip roller 38 for selectively moving the nip roller 38 with respect to the adjacent fold roller 36 based on predetermined collation thickness data to change the nip spacing for sequential collations. An exemplary adjustment system is shown in FIGS. 3 and 4.

In the illustrated embodiment, the adjustment system 48 comprises an adjustment device 50 associated with each end of the shaft 40. In one embodiment, the adjustment device 50 comprises a fitting 52 rotatably receiving the end of the shaft 40 and a drive element 54 for moving the fitting 52 with respect to the adjacent fold roller 36.

Figure 4:
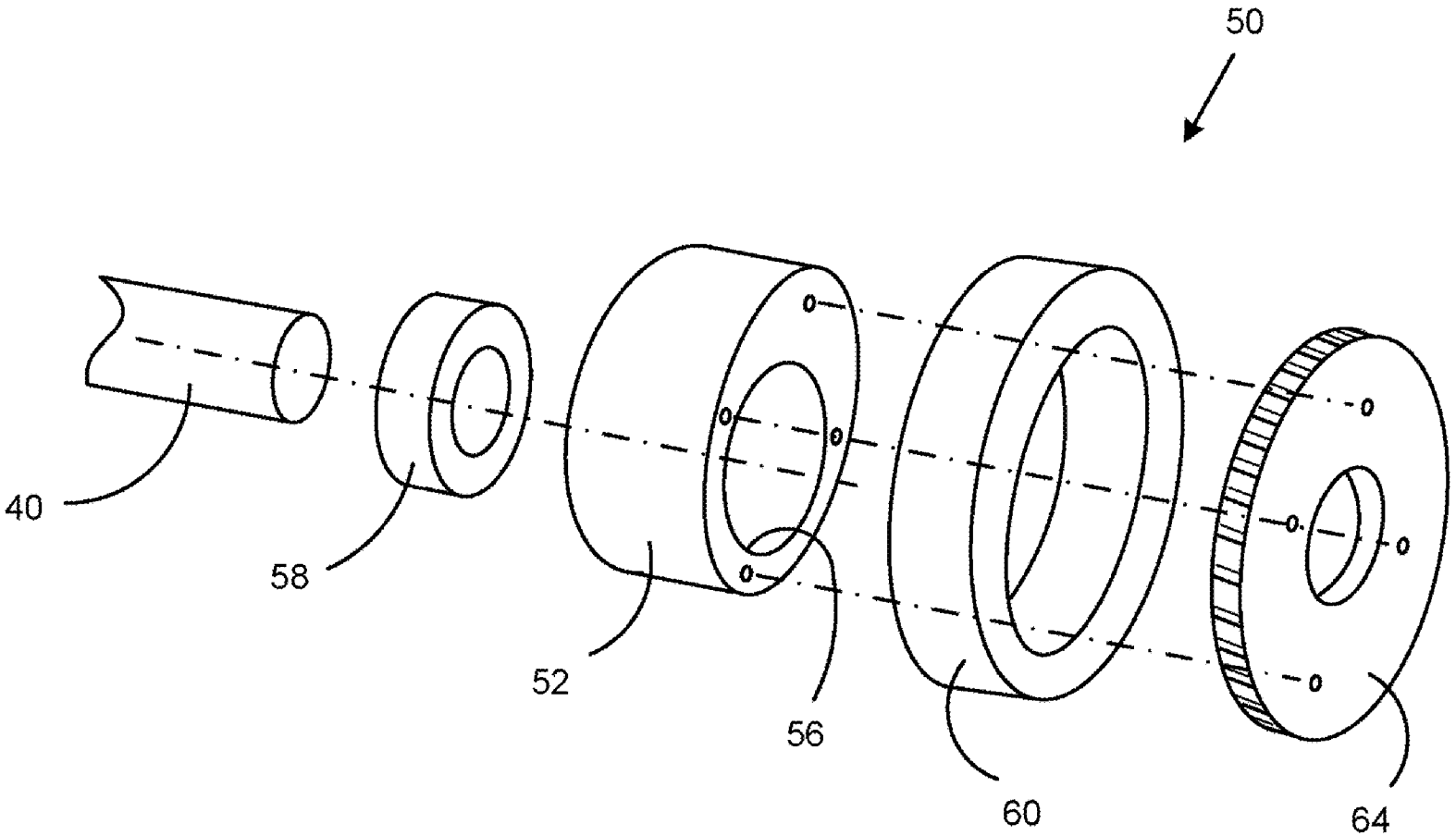
FIG. 4 is an exploded view of a portion of the adjustment device according to an embodiment of the invention.

An embodiment of a portion of the adjustment device 50 is shown in an exploded view in FIG. 4, in which the fitting 52 receives the end of the shaft 40 in an eccentric opening 56. In that embodiment, a first bearing 58 is disposed on the end of the shaft 40. The first bearing 58 is disposed within the eccentric opening 56 of the fitting 52.

The fitting 52 is disposed in a second bearing 60, which may be secured in the housing 39 of the folder 12. In the illustrated embodiment, a gear 64 is secured to the fitting 52 for selectively rotating the fitting 52 and, in turn, moving the shaft 40 in an arcuate motion. In one embodiment, the drive element 54 comprises a stepper motor (not shown). The stepper motor may be used to drive the gear 64 and, in turn, rotate the fitting 52, using a chain (not shown) as a transmission device. In operation, the adjustment device 50 moves the shaft 40 in an arcuate motion and thereby converts rotation of the gear 64 and the fitting 52 into displacement of the shaft 40.

In other embodiments, a pulley and belt arrangement may be used to move the fitting 52 with respect to the adjacent fold roller 36. In addition, other embodiments may use alternative drive elements, including servo motors, pneumatic cylinders, linear actuators, or other drive elements, for example. Other transmission devices may also be used, including timing belts, rigid links, lead screws, cam and follower arrangements, and other devices, for example.

In the illustrated embodiment, the adjustment device 50 is associated with each end of the shaft 40. Accordingly, the adjustment system 48 associated with a nip roller 38 imparts substantially identical motion to the ends of the shaft 40 to ensure even nip spacing. As shown schematically in FIG. 3, a single drive element 54 moves the fittings 52 associated with both ends of a respective shaft 40. Other arrangements may also be used.

The folder 12 further comprises a controller 66 to control the operation of the various drive elements and actuators. In some embodiments, the controller 66 also controls the operation of an associated document production and handling system, such as the inserter 10.

In some arrangements, inserter machines create mailpieces based on a data file that contains information regarding the individual mailpieces, or based on information read directly from a code on the documents of the mailpieces. In both arrangements, the inserter is instructed to create collations having a specific number of content pages and, accordingly, a predetermined thickness. The thickness data is provided from the data file or is read from the code on the collation and received by the controller 66. In some embodiments, the data file is stored on a processing device (not shown) associated with the controller 66. Thus, the controller 66 receives the thickness data and generates control signals for the adjustment system 48 associated with each nip roller 38.

During operation, the plurality of fold rollers 36 and the plurality of nip rollers 38 continuously rotate in the directions shown by arrows in FIG. 2. The folder shown in FIG. 2 is configured to fold collations into a "Z-fold" configuration, based on the arrangement of buckle chutes and deflectors. Other arrangements may also be used to fold collations into "C-folds," bi-folds, and other types of folds, for example.

A collation 43 is shown in FIG. 2 being received in the input nip 41. From the input nip 41, the collation 43 enters a first buckle chute 68, which has a depth shorter than the length of the collation 43. As the leading edge of the collation 43 hits a stop 70 in the first buckle chute 68, the continuous rotation of the rollers 36, 38 causes the collation 43 to buckle and fold.

As the collation 43 advances, the fold is drawn into a first intermediate nip 44, which delivers the partially folded collation to a first deflector 72. The collation 43 passes the first deflector 72 with the folded portion as the leading edge and passes through a second intermediate nip 44 to the second buckle chute 74.

Next, the folded portion enters the section buckle chute 74, which also has a depth shorter than the length of the partially folded collation. Again, as the leading edge of the collation hits the stop 76 in the second buckle chute 74, the continuous rotation of the rollers 36, 38 causes the collation to buckle and fold.

As the collation 43 advances, the fold is drawn into a third intermediate nip 44, which delivers the partially folded collation to a second deflector 78. From the second deflector 78, the fully folded collation 43 enters the output nip 46, where it is discharged from the folder 12 in the Z-fold configuration, as shown in FIG. 2.

According to embodiments of the invention, as the collation 43 approaches the folder 12, each nip roller 38 is selectively moved with respect to the adjacent fold roller 36 based on predetermined collation thickness data to change the nip spacing to accommodate the particular collation.

As discussed above, sequential collations may comprise bills or financial statements, for example, having different numbers of sheets and, therefore, different thicknesses. In order to process the collations, the controller 66 receives the thickness data and generates control signals for the adjustment system 48 associated with each nip roller 38 to accommodate the varied thicknesses of the sequential collations.

In one embodiment, the adjustment system 48 sets the spacing of all nips in the folder 12 to a common nip spacing. In other embodiments, downstream nips are given a larger nip spacing to accommodate the increased thickness of partially folded and fully folded collations. The adjustment system 48 associated with each nip roller 38 may be independently adjusted. Thus, other arrangements may be used in which the spacing of each nip is optimized for a given application.

In one embodiment, prior to operation, the adjustment devices 50 for each nip roller 38 are calibrated by rotating the fittings 52 such that the thinnest portion of the fitting is at a top dead center position. That orientation corresponds to the smallest nip spacing. The respective nip rollers 38 may be adjusted from the calibrated "zero" position, as needed. In some embodiments, rotary encoders may be used to precisely track the positions and the corresponding nip spacing of the nip roller shafts.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of folding collations, comprising:
rotating a plurality of fold rollers;
rotating a plurality of nip rollers, each nip roller forming a nip having a nip spacing with an adjacent fold roller;
receiving collations in an input nip;
delivering the collations to one of a buckle chute and a deflector to form folded collations in a plurality of intermediate nips;
discharging the folded collations from an output nip; and
selectively moving each nip roller with respect to the adjacent fold roller based on predetermined collation thickness data to change the nip spacing for sequential collations using an adjustment system associated with the nip roller, wherein the adjustment system includes an adjustment device operative to impart substantially identical motion to the ends of each nip roller shaft, the adjustment device including a fitting rotatably receiving the end of the shaft, and a drive element for moving the fitting with respect to the adjacent fold roller.

2. The method of claim 1, wherein the fitting receives the end of the shaft in an eccentric opening and, wherein the method further comprises rotating the fitting using the drive element.

3. The method of claim 1, wherein the adjustment device moves the shaft in an arcuate motion.

4. The method of claim 1, wherein a single drive element moves the fittings associated with both ends of a respective nip roller shaft.

5. The method of claim 1, wherein the thickness data is provided from a data file or is read from a code on the collation.

6. The method of claim 5, further comprising:
receiving the thickness data in a controller; and
generating control signals for the adjustment system associated with each nip roller based on the thickness data.

7. A folder, comprising:
a plurality of rotatable fold rollers;
a plurality of rotatable nip rollers, each nip roller including a shaft and a collation contact surface disposed on the shaft and forming a nip having a nip spacing with an adjacent fold roller, wherein the nips comprise:
an input nip for receiving collations;
a plurality of intermediate nips for delivering the collations to one of a buckle chute and a deflector to form folded collations; and
an output nip for discharging the folded collations; and
an adjustment system associated with each nip roller for selectively moving the nip roller with respect to the adjacent fold roller based on predetermined collation thickness data to change the nip spacing for sequential collations, the adjustment system including an adjustment device operative to impart a substantially identical motion to the ends of each nip roller shaft, the adjustment device including a fitting rotatably receiving the end of the shaft; and a drive element for moving the fitting with respect to the adjacent fold roller.

8. The folder of claim 7, wherein the fitting receives the end of the shaft in an eccentric, opening and, wherein the drive element is configured to rotate the fitting.

9. The folder of claim 7, wherein the adjustment device moves the shaft in an arcuate motion.

10. The folder of claim 7, wherein a single drive element moves the fittings associated with both ends of a respective shaft.

11. The folder of claim 7, wherein the thickness data is provided from a data file or is read from a code on the collation.

12. The folder of claim 11, further comprising a controller for receiving the thickness data and generating control signals for the adjustment system associated with each nip roller based on the thickness data.

13. A folder, comprising:
a plurality of rotatable fold rollers;
at least one rotatable nip roller forming a nip with an adjacent fold roller for delivering collations to a buckle chute to form folded collations, wherein the nip defines a nip spacing;
a controller for receiving the thickness data from a data file or from a code reader and generating control signals for the adjustment system associated with each nip roller based on the thickness data; and
an adjustment system associated with each nip roller for selectively moving the nip roller with respect to the adjacent fold roller based on predetermined collation thickness data, to change the nip spacing for sequential collations, wherein the adjustment system comprises an adjustment device associated with each end of a nip roller shaft, the adjustment device comprising:
a fitting rotatably receiving the end of the shaft; and
a drive element for moving the fitting with respect to the adjacent fold roller.

14. The folder of claim 13, further comprising:
a plurality of rotatable nip rollers forming nips with adjacent fold rollers, wherein the nips comprise:
an input nip for receiving collations;
a plurality of intermediate nips for delivering the collations to one of a buckle chute and a deflector to form folded collations; and
an output nip for discharging the folded collations.

* * * * *